US006427410B1

(12) United States Patent
Lind

(10) Patent No.: US 6,427,410 B1
(45) Date of Patent: Aug. 6, 2002

(54) DEVICE FOR FIXING FACING SLABS

(75) Inventor: Stefan Lind, Waldachtal (DE)

(73) Assignee: Fischerwerke Artur Fischer GmbH & Co. KG, Waldachtal (DE)

( * ) Notice: Subject to any disclaimer, the term of this patent is extended or adjusted under 35 U.S.C. 154(b) by 0 days.

(21) Appl. No.: 09/402,233

(22) PCT Filed: Apr. 22, 1998

(86) PCT No.: PCT/EP98/02377

§ 371 (c)(1),
(2), (4) Date: Sep. 30, 1999

(87) PCT Pub. No.: WO98/49412

PCT Pub. Date: Nov. 5, 1998

(30) Foreign Application Priority Data

Apr. 30, 1997 (DE) ..... 197 18 299

(51) Int. Cl.[7] ..... E04B 2/32
(52) U.S. Cl. ..... 52/508; 52/511
(58) Field of Search ..... 52/235, 508, 510, 52/511, 513

(56) References Cited

U.S. PATENT DOCUMENTS 4,525,962 A * 7/1985 Gartner ..... 52/235

FOREIGN PATENT DOCUMENTS

| | | | |
|---|---|---|---|
| CH | 659679 | * | 2/1987 |
| DE | 3432513 | * | 3/1990 |
| DE | 92 14 581.7 | | 1/1993 |
| DE | 295 16 664 | * | 7/1996 |
| EP | 264707 | * | 4/1988 |
| JP | 5-331939 | * | 12/1993 |

* cited by examiner

*Primary Examiner*—Michael Safavi
(74) *Attorney, Agent, or Firm*—Michael J. Striker

(57) ABSTRACT

A device (10) for fixing facing panels (14) to a wall (16) by means of a transverse support (12), on which the facing panels (14) can be suspended. To render the transverse support (12) stable, the invention proposes constructing the transverse support (12) as a closed, hollow profiled member. This has the advantage that even heavy facing panels (14) can be mounted on the wall (16). Moreover, the invention proposes vertical supports (32) for mounting the transverse support (12), which are to be mounted on the wall (16) at a distance therefrom by means of length-adjustable rods (42), which are pivotally connected to the vertical supports (32) and to the wall (16). A single rod (42) forms a movable bearing (40) and two rods (42) mounted at an angle to one another form a fixed bearing (38). The advantage of this method of mounting the transverse support (12) on the wall (16) is the ease of vertical adjustment and ease with which wall unevenness can be accommodated. It is a further advantage that the rods (42) do not exert any torques on their wall fixings.

9 Claims, 3 Drawing Sheets

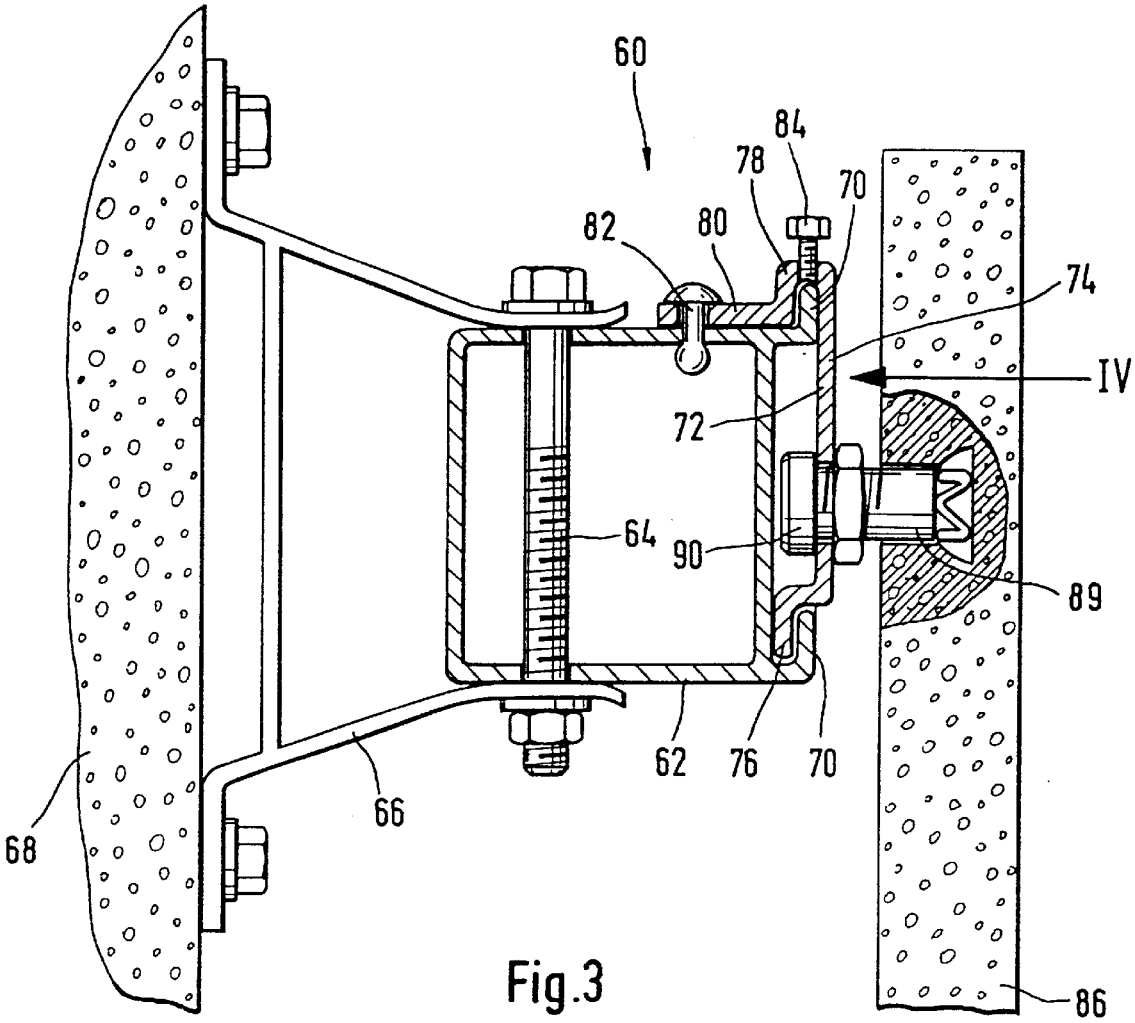
Fig.3
Fig. 4
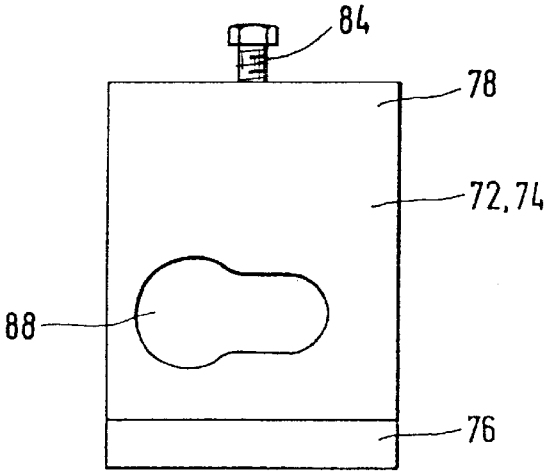

DEVICE FOR FIXING FACING SLABS

The invention relates to a device having the features of the preamble to claim 1 for fixing facing panels to a wall of a building.

A device of that kind, which is provided for fixing glass panels as facade cladding, is known from DE-G 92 14 581. The known device comprises a transverse support having an approximately C-shaped profile, which is screwed to the wall with a cross wall. The limb walls of the transverse support have grooves into which profiled members of hook-shaped cross-section, which form suspension elements, can be hung. The suspension elements are screwed to the glass panels. The disadvantage of the known device is the low cross-sectional stability of the transverse support, the limb walls of which are bent downwards by the glass panels hung on them at a distance from the wall. The known device is poorly suited to fixing heavy facing panels.

The invention is based on the problem of constructing a stable device of the kind mentioned in the introduction.

That problem is solved in accordance with the invention in that the transverse support is in the form of a closed, hollow profiled member. Compared with the known open, C-shaped profiled member, a closed, hollow profiled member has the advantage that it is considerably more stable as regards deformation of its cross-section by the load of the facing panels acting on the transverse profiled member at a distance from the wall. A stable transverse support of modest thickness and consequently modest weight can be manufactured from aluminium, for example, by a drawing process.

For hanging the suspension elements, in a construction of the embodiment the transverse support has an upwardly projecting rib extending in the longitudinal direction of the transverse support.

To accommodate different thermal expansions in the wall and the transverse support, the device according to the invention has a longitudinal guide, by which the longitudinal support can be mounted, so that it is displaceable in its longitudinal direction, on the wall. The transverse support is immovably secured at one point (fixed point) to the wall and is able to expand and contract relative to the wall in the longitudinal guide without stresses developing. This has the advantage, in particular, that the points at which the transverse support is fixed to the wall are not subject to shearing stress.

[1]Presumably in error for "Querträger" (transverse support)—translator.

Moreover, in a preferred construction of the invention, the suspension elements are displaceable in the longitudinal direction of the transverse support. This has the advantage, firstly, that the suspension elements can be hung at any point on the transverse support. It is a further advantage that different thermal expansion of the transverse support and a facing panel can be accommodated by displacing the suspension element or elements along the transverse support, so that no stresses develop. One of the suspension elements of a facing panel is preferably fixed immovably to the transverse support (fixed point) in a manner known per se, for example, by means of a screw or clamping wedge.

To avoid stress in the form of torque on the profiled member of the transverse support, and in particular a torsional moment, the suspension elements hung on the upper side of the transverse support are supported on a front side of the transverse support. This reduces stress on the transverse support. Moreover, the facing panel is mounted at approximately the same height on the suspension element as the suspension element is hung on the transverse support.

In a preferred construction of the invention, the device has a vertical adjustment device, with which the height of the suspension element on the transverse member can be adjusted. Thus, firstly, the height of the facing panel and also the horizontal and vertical alignment thereof can be very accurately set. This is necessary to achieve identical gap widths between the facing panels. A further advantage of the vertical adjustment facility of the suspension elements is that when there are more than two suspension elements mounted at the same height on a facing panel, their suspension force can be adjusted to be approximately the same, that is, each suspension element carries approximately the same load.

In a development of the invention, the facing panel is mountable by suspension on the suspension element. For suspension of the facing panel, the suspension element can have a suspension opening, for example, in the form of a keyhole, in which the facing pane can be suspended by means of an anchoring member anchored to the panel and having a head. This construction of the invention has the advantage that after mounting the suspension elements on the transverse support, the facing panels can be mounted on the suspension elements. This is especially advantageous when the corresponding suspension element is to be immovably fixed to the transverse support to constitute a fixed point. It is a further advantage that the facing panels can be dismounted subsequently without problems.

In a development of the invention, the transverse support is mounted on vertical supports, which can be mounted approximately vertically and spaced from one another on the wall. The vertical supports allow, for example, unevenness in the wall to be accommodated, which facilitates mounting of the transverse supports. For longitudinal displaceability of the transverse supports, serving to compensate for thermal expansion, it is also an advantage that the transverse supports are not mounted directly on the wall.

In a preferred construction, the vertical supports are mounted on the wall with a fixed bearing and one or more movable bearings, to provide an opportunity for compensation also between wall and vertical supports when the thermal expansions of the vertical support and the wall are different.

In a construction of the invention, the movable bearing is in the form of a rod, which is pivotally mounted on the wall and on the vertical support by means of pivotal fittings.

As fixed bearing, two such rods are provided, which, together with the vertical support and/or the wall, form a triangle, and in this way hold the vertical support immovably on the wall. The rods of the fixed bearing can be mounted on the wall and/or on the vertical support rigidity, that is, with no facility for angular change, or so as to pivot. Pivotal mounting on the wall has the advantage that no torque that would place a load on the fixings in addition to the weight of the facing panels, is exerted on fixings of the rods on the wall.

For precise fitting, the rods are preferably adjustable in length.

The invention is explained in detail hereinafter with reference to an exemplary embodiment illustrated in the drawings, in which:

FIG. 3 is a second embodiment of a device according to the invention in side view, and FIG. 4 is an end view of a suspension element of the device from FIG. 3 seen in the direction of the arrow IV in FIG. 3.

Figure 1:
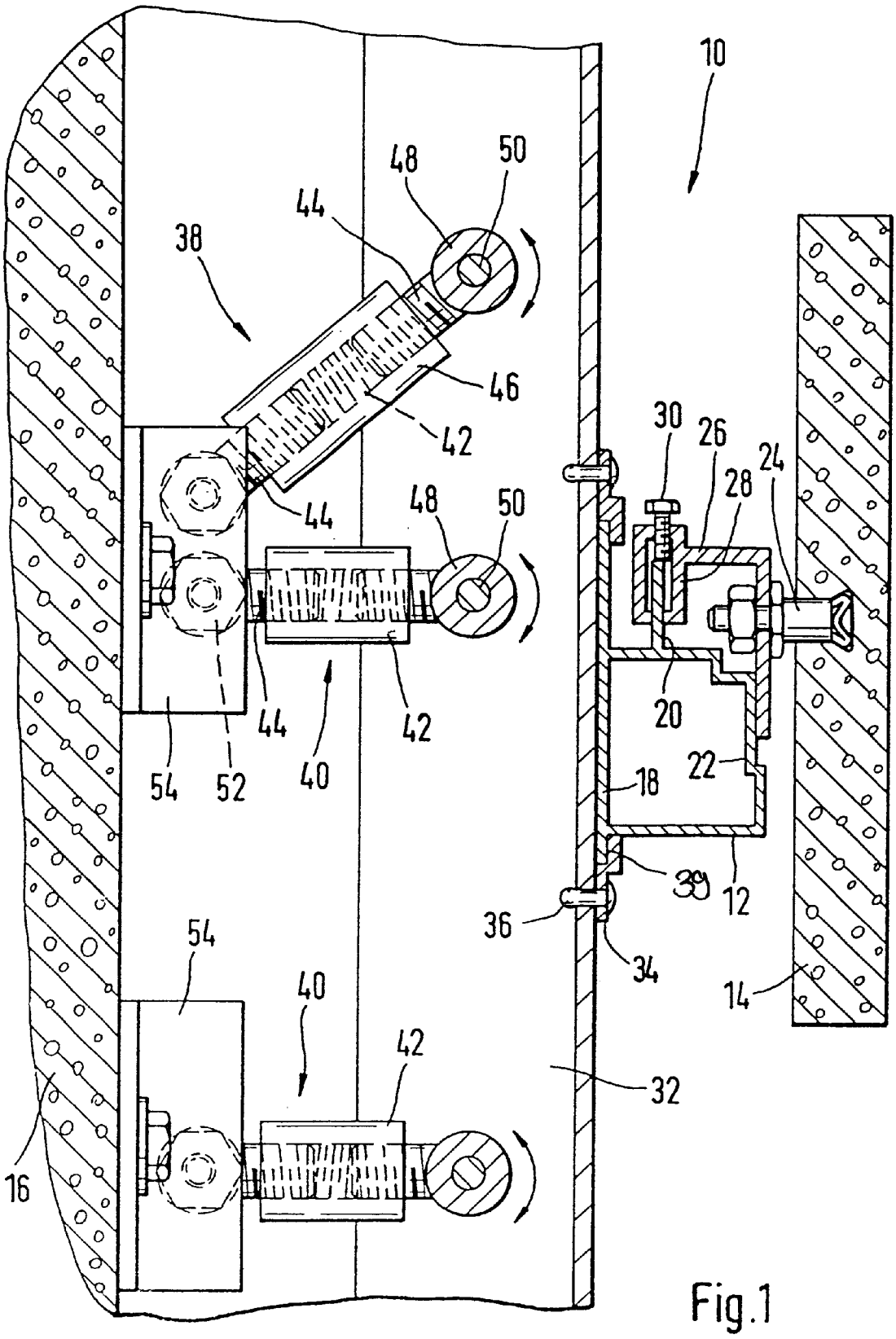
FIG. 1 shows a device according to the invention in side view.

The device according to the invention illustrated in the drawings and denoted as a whole by the reference number 10 comprises a transverse support 12 to which a facing panel 14 is fixed. The transverse support 12 comprises a closed, approximately rectangular, hollow profiled member, one lateral wall of which, facing a wall 16 of a building, projects in the form of a base plate 18 integral with the hollow profiled member above and below the hollow profiled member. A rib 20 integral with the transverse support 12 and running in the longitudinal direction of the transverse support 12 is arranged close to the base plate 18 on the profiled support 12 and projects upwards. A lateral wall 22 of the hollow profiled member of the transverse support 12 lying opposite the base plate 18 has two staircase-like steps.

The facing panel 14 is provided on its rear side facing the wall 16 with undercut blind bores, into which anchors 24 for spaced mounting known per se are inserted. A total of four anchors for spaced mounting are provided on the facing panel 14 and are arranged on the facing panel in a square offset inwardly from the lateral edges. In the drawing, only the upper, left-hand holder 24 for spaced mounting is visible. When the facing panels 14 are large and heavy, more anchors 24 for spaced mounting can be provided.

Each anchor 24 for spaced mounting is screwed to a suspension element 26. This suspension element 26 is hook-shaped in cross-section. It forms an L-shaped member, the longer limb of which is directed downwards and faces the facing panel 14. The anchors 24 of the facing panel 14 for spaced mounting are screwed to this longer limb. A box-type profiled member 28 that is slotted on its underside and is small, in particular narrow, in comparison with the transverse support 12, is arranged at the end of the shorter limb and is integral with the suspension element 26. The suspension element 26 is placed with the slotted, box-type profiled member 28 onto the rib 20 of the transverse support 12, and is thus suspended on the transverse support 12. With its longer limb, the L-shaped suspension element 26 bears against the front wall 22 of the transverse support 12. The anchor 24 for spaced mounting is located at approximately the same level as that at which the box-type profiled member 28 of the suspension element 26 engages laterally on the rib 20 of the transverse support 12. An adjusting screw 30 screwed from above into the box-type profiled member 28 of the suspension element 26 stands on the rib 20 of the transverse support 12 and enables the facing panel 14 to be adjusted vertically.

The suspension element 26 is displaceable in the longitudinal direction of the transverse support 12, to accommodate different thermal expansions of the facing panel 14 and transverse support 12. One of the suspension elements 26 is fixed immovably (fixed point) in a manner known per se, for example, by means of a clamping screw or a clamping wedge (not shown), to the transverse support 12.

The transverse support 12 can be fastened, for example, by screws, directly to the wall 16. In the exemplary embodiment illustrated, the transverse support 12 is mounted on the wall 16 with vertical supports 32, which have a U-shaped profile. Mounting the transverse support 12 on the vertical supports 32 is effected by means of guide plates 34, which are secured to the vertical support 32 by blind rivets 36. On their side facing the hollow profiled member of the transverse support 12, the guide plates 34 have a cranked portion 39, with which they engage over the base plate 18 of the transverse support projecting above and below the hollow profiled member. The guide plates 34 form a longitudinal guide of the transverse support 12, which allows different thermal expansion of the transverse support 12 and the wall 16 to be accommodated. The transverse profiled member 12 is immovably mounted (fixed point) on a vertical support 32, for example, by fixing with blind rivets directly to the vertical support 32.

The vertical support 32 is mounted oh the wall 16, spaced therefrom, by means of a fixed bearing 38 and one or more movable bearings 40. The fixed and movable bearings 38, 40 comprises rods 42, which form spacers. Each rod 42 comprises two threaded bolts 44, which are screwed into a threaded sleeve 46. One of the threaded bolts 44 has a right-hand thread and the other a left-hand thread, so that the length of the rods 42 is adjustable by turning their threaded sleeve 46. Articulated sleeves 48, which are pivotally connected by means of through-bolts 50 to the vertical support 32 and to a bearing plate 54 of the fixed and movable bearings 38, 40 respectively, are mounted transversely at the outer ends of the threaded bolts 44. The through-bolts 50 are secured with lock nuts 52. The bearing plates 54 are screwed to the wall 16. The rods 42 can be pivoted about horizontal axes running parallel to the wall 16.

The fixed bearing 38 comprises two rods 42, which are pivotally mounted close to one another on a common bearing plate 54. With their other ends, the rods 42 of the fixed bearing 38 are pivotally connected at a distance from one another to the vertical support 32, that is, the two rods 42 of the fixed bearing 38 are arranged at an angle to one another; together with the vertical support 32 they form a triangular construction which fixes the vertical support 32 both at distance from the wall 16 and also as regards height, and hence rigidly, to the wall 16.

The movable bearing 40 comprises a rod 42 which is pivotally mounted on the wall 16 by means of a bearing plate 54 and is pivotally mounted on the vertical support 32. The rod 42 of the movable bearing 40 projects approximately horizontally from the wall 16. The movable bearing 40 holds the vertical support 32 at a predetermined distance from the wall 16 and permits a vertical movement as a consequence of thermal expansion. The length-adjustable rods 42 both of the fixed bearing 38 and of the movable bearing 40 allow the vertical support 32 to be adjusted easily, and in particular allow unevenness in the wall to be compensated.

Figure 2:
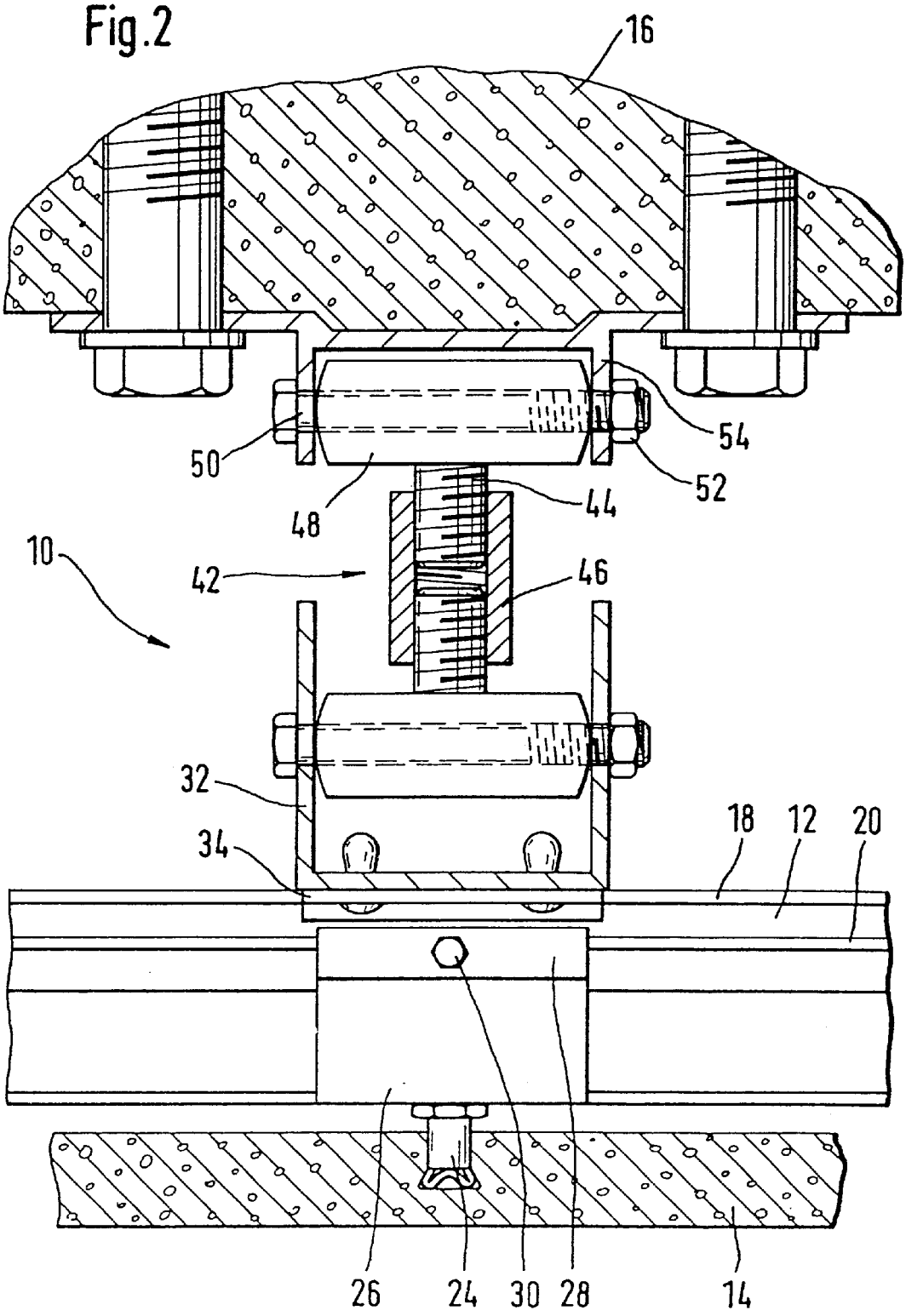
FIG. 2 is a plan view of the device from FIG. 1.

The device 60 according to the invention shown in FIG. 3 likewise comprises a transverse support 62 in the form of a hollow profiled member. This transverse support 62 can be mounted in the same way as the transverse support 12 shown in FIGS. 1 and 2 on vertical supports (not shown). In the case of the exemplary embodiment illustrated in FIG. 3, the transverse support 62 is connected by means of a through-bolt 64 to a wall support 66, which in turn is screwed to a wall 68.

The transverse support 62 has two ribs 70 for suspension of a suspension element 72. The ribs 70 are arranged on the transverse support 62 on an upper and a lower front edge of the transverse support 62 at a distance in front of the front side thereof remote from the wall 68. The ribs 70 are integral with the transverse support 62.

The suspension element 72 comprises a plate 74, the lower edge 76 of which is cranked and engages behind the lower rib 70 of the transverse support 62. The suspension element 72 engages with an upper edge 78 of U-shaped cross-section behind the upper rib 70 of the transverse support 62.

For construction of the suspension element 72 as a fixed point, the plate-like suspension element 72 continues from its U-shaped upper edge 78 as a fixing extension 80 for a little way at right angles to its plate 74 on a top side of the transverse support 62. By means of a rivet 82, or a screw (not shown), the suspension element 72 can be immovably fixed to the transverse support 62. To use the suspension element 72 as a movable bearing displaceable in the longitudinal direction of the transverse support 62, the rivet 82, or the screw (not shown), is omitted.

For vertical adjustment, an adjusting screw 84 that rests on the rib 70 of the transverse support 62 is screwed in through the U-shaped upper edge 78 of the suspension element 72. To mount a facing panel 86 on the suspension element 72, a keyhole-shaped suspension opening 88 is made in the plate 74 of the suspension element 72. The suspension opening 88 can be seen in FIG. 4, which shows an end view of the suspension element 72 on its own. An anchor 89 for spaced mounting is anchored in the facing panel 86; the head 90 of the anchor is inserted through the large circular opening of the keyhole-shaped suspension opening 88 and by displacement is brought into the narrower part of the suspension opening so that it engages positively behind the plate 74 of the suspension element 72.

The construction of the invention illustrated in FIGS. 3 and 4 has the advantage that the facing panel 86 can be mounted on the suspension element 72 after the suspension element 72 has been mounted on the transverse support 62. Subsequent dismounting of the facing panel 86 is also easily possible. Since the suspension element 72 engages at both its edges 76, 78 with the transverse support 62, in addition to the wall mounting illustrated, the device 60 is also suitable, for example, for ceiling suspension. This corresponds to a view of FIG. 3 with the right-hand edge of the page at the bottom. In that case, reference number 68 would indicate a ceiling and reference number 86 would indicate a suspended ceiling panel. Moreover, the suspension element 72 can also be mounted on the wall 68 or on one of the vertical supports 32 illustrated in FIGS. 1 and 2 and the facing panel can be mounted on the transverse support 62 by providing the keyhole-shaped suspension opening in the transverse support 62 (not shown), for example.

What is claimed is:

1. A device for fixing facing panels to a wall, having a transverse support to be mounted horizontally on the wall and having suspension elements that are mountable on the facing panel and suspendable on the transverse support, wherein the transverse support (12; 62) comprises a closed hollow profiled member, wherein said transverse support (12; 62) comprises an upwardly projecting rib (20, 70) running in the longitudinal direction of the transverse support for suspension of the suspension elements, said suspension elements suspendable on the transverse support (12; 62) so as to be displaceable in the longitudinal direction, wherein said suspension elements (26; 72) are supported on a front side of the transverse support (12; 62), and the transverse support (12) is mounted on vertical supports (32) which are secured, running vertically, to the wall (16), characterized in that the vertical supports comprise a fixed bearing (38) and a movable bearing (40), with which they are arranged to be mounted on the wall (16).

2. A device according to claim 1, characterised in that the movable bearing (40) comprises a rod (42) which is pivotally mounted on the vertical support (32) and on the wall (16).

3. A device according to claim 1, characterised in that the transverse support (12) has a longitudinal guide (34, 38) with which it is mountable so as to be displaceable in its longitudinal direction, on the wall (16).

4. A device according to claim 1, characterised in that the fixed bearing (38) comprises two rods (42), which are pivotally mounted on the vertical support (32) and on the wall (16) and which together with the vertical support (32) and/or the wall (16) form a triangular construction.

5. A device according to claim 2 or 4, characterised in that the rods (42) are adjustable in length.

6. A device according to claim 1, characterised in that the facing panel (14) is mounted on the suspension element (26) approximately at the same height as the suspension element is arranged to be suspended on the transverse support (12).

7. A device according to claim 1, characterised in that the device (10; 60) comprises a vertical adjustment arrangement (30; 84), with which the height of the suspension element (26; 72) on the transverse support (12, 62) is adjustable.

8. A device according to claim 1, characterised in that the facing panel (86) is capable of being mounted by suspension on the suspension element (72).

9. A device according to claim 1, characterised in that the suspension element (72) comprises a keyhole-shaped suspension opening (88) for suspension of the facing panel (86).

* * * * *